US009418589B2

(12) United States Patent
Kim et al.

(10) Patent No.: US 9,418,589 B2
(45) Date of Patent: Aug. 16, 2016

(54) DISPLAY DEVICE FOR CONTROLLING LIGHT EMISSION PERIOD BASED ON THE SUM OF GRAY VALUES AND DRIVING METHOD OF THE SAME

(71) Applicant: Samsung Display Co., Ltd., Yongin, Gyeonggi-do (KR)

(72) Inventors: Min-Cheol Kim, Yongin (KR); In-Hwan Kim, Yongin (KR); Byung-Geun Jun, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 361 days.

(21) Appl. No.: 13/762,078

(22) Filed: Feb. 7, 2013

(65) Prior Publication Data

US 2014/0028732 A1 Jan. 30, 2014

(30) Foreign Application Priority Data

Jul. 25, 2012 (KR) ..... 10-2012-0081298

(51) Int. Cl.
*G09G 3/32* (2016.01)

(52) U.S. Cl.
CPC ..... *G09G 3/3208* (2013.01); *G09G 3/3266* (2013.01); *G09G 2300/0819* (2013.01); *G09G 2300/0861* (2013.01); *G09G 2320/0233* (2013.01); *G09G 2320/045* (2013.01); *G09G 2360/16* (2013.01)

(58) Field of Classification Search
None
See application file for complete search history.

(56) References Cited

U.S. PATENT DOCUMENTS

2004/0263502 A1* 12/2004 Dallas ..... G02F 1/133553 345/204
2005/0243077 A1* 11/2005 Chung ..... G09G 3/3258 345/204
2008/0218450 A1* 9/2008 Park ..... G09G 3/3233 345/76
2013/0140537 A1* 6/2013 Ha ..... H01L 27/3262 257/40
2014/0347405 A1* 11/2014 Kumeta ..... G09G 5/10 345/690

FOREIGN PATENT DOCUMENTS

KR 10-2006-0104855 A 10/2006
KR 10-0707640 B1 4/2007
KR 10-2010-0016634 A 2/2010
KR 10-1051573 B1 7/2011

* cited by examiner

*Primary Examiner* — Ryan A Lubit
(74) *Attorney, Agent, or Firm* — Knobbe, Martens, Olson & Bear, LLP

(57) ABSTRACT

A display device is disclosed. In one aspect, the device includes a display panel that includes i) a plurality of pixels including first and second light emission control transistors, ii) a first light emission driver configured to generate a first switching control signal, iii) a second light emission driver configured to generate a second switching control signal, iv) a signal controller configured to generate and transfer a first light emission control signal and v) a light emission controller configured to generate and transfer a second light emission control signal. The light emission controller acquires information of a gray depth from a result value obtained by summing gray data, determines a light emission control algorithm according to the gray depth, and generates the second light emission control signal so that the pixels emit light during different light emission periods for a plurality of frames.

20 Claims, 6 Drawing Sheets

DISPLAY DEVICE FOR CONTROLLING LIGHT EMISSION PERIOD BASED ON THE SUM OF GRAY VALUES AND DRIVING METHOD OF THE SAME

CROSS-REFERENCE TO RELATED APPLICATION

This application claims priority to and the benefit of Korean Patent Application No. 10-2012-0081298 filed in the Korean Intellectual Property Office on Jul. 25, 2012, the entire contents of which are incorporated herein by reference.

BACKGROUND (a) Field

The described technology generally relates to a display device and a driving method thereof.

(b) Description of the Related Technology

An organic light emitting diode (OLED) display displays an image by using an OLED which generates light by recoupling an electron and a hole. OLED displays generally have a rapid response speed, consume low power, and have excellent emission efficiency, luminance and viewing angle, and thus have drawn attraction.

Generally, an OLED display is classified into a passive matrix OLED display (PMOLED) and an active matrix OLED display (AMOLED) according to a driving mode of the organic light emitting diode.

The passive matrix type is a driving mode in which a positive electrode and a negative electrode are formed to be perpendicular to each other and a negative electrode line and a positive electrode line are selectively driven, and the active matrix type is a driving mode in which a thin film transistor and a capacitor are integrated in each pixel to maintain voltage by capacitance. The passive matrix type has a simple structure and is cheap, but it is difficult to implement a large-sized or high-precision panel. On the contrary, the active matrix type may implement the large-sized or high-precision panel, but there are problems in that a control method thereof is technically difficult and costs are relatively high.

From the viewpoint of resolution, contrast, and operation speed, the active matrix organic light emitting diode display (AMOLED) in which light is selectively emitted for each unit pixel has become a mainstream.

SUMMARY

One inventive aspect is a display device having advantages of implementing accurate gray expression and clear image quality according to a data signal by compensating a gray spot generated due to threshold voltage distribution of a driving transistor of a pixel.

Another aspect is a driving method of a display device having advantages of compensating a gray spot due to threshold voltage distribution of a driving transistor by controlling emission driving of a pixel without high-speed driving of a frame of a display panel.

Another aspect is a display device, including: a display panel including an organic light emitting diode configured to emit light by a driving current according to an image data signal, a driving circuit, and a plurality of pixels including a first light emission control transistor and a second light emission control transistor configured to control the light emission of the organic light emitting diode; a first light emission driver configured to generate a first switching control signal controlling a switching operation of the first light emission control transistor; a second light emission driver configured to generate a second switching control signal controlling a switching operation of the second light emission control transistor; a signal controller configured to generate and transfer a first light emission control signal controlling an operation of the first light emission driver; and a light emission controller configured to generate and transfer a second light emission control signal controlling an operation of the second light emission driver.

The light emission controller may acquire information of a gray depth from a result value obtained by summing gray data according to an external image signal, determine a light emission control algorithm according to the gray depth, and generate the second light emission control signal so that the plurality of pixels emit light as different light emission periods for a plurality of predetermined frames according to the light emission control algorithm.

The gray depth may be determined as a value stored in a carry bit among result values obtained by summing the gray data.

Meanwhile, the light emission controller may pre-set and store the number of the plurality of predetermined frames and the light emission control algorithm according to the gray depth.

The plurality of predetermined frames may include light emission periods which complementarily vary according to the light emission control algorithm, as a basic unit frame repeated according to the light emission control algorithm in the entire frame.

Here, a sum of light emission periods which complementarily vary in the plurality of predetermined frames may be a light emission period in one frame of a general light emission driving, but it is not limited thereto.

A brightness value of an image displayed for different light emission periods of the plurality of predetermined frames may be a brightness value according to gray data included in the external image signal.

Further, the first switching control signal may be maintained at a gate on voltage level of the first light emission control transistor for the same period as the light emission period in one frame of the general light emission driving. In addition, the second switching control signal may be maintained at a gate on voltage level of the second light emission control transistor for different light emission periods according to the light emission control algorithm.

Meanwhile, the first switching control signal may be transferred at a gate on voltage level of the first light emission control transistor for the same time for each frame among the plurality of predetermined frames. In addition, the second switching control signal may be transferred at a gate on voltage level of the second light emission control transistor for different periods for each frame of the plurality of predetermined frames.

The second light emission driver may include a voltage converter controlling a pulse voltage level of the second switching control signal according to the second light emission control signal.

Further, the light emission controller may calculate the gray depth by summing the gray data by a unit of all pixels included in the display panel or a plurality of pixels unit a unit of a plurality of pixels included in each pixel line.

The light emission controller may include an input data analyzing unit configured to analyze information of a gray depth from the result value obtained by summing the gray data according to the external image signal; a light emission driving setting unit configured to pre-set the gray depth and a light emission control algorithm according to the number of the plurality of predetermined frames and determine a light emission control algorithm corresponding to a gray depth of the analyzed image signal among the set light emission control algorithms; and a light emission control signal generator configured to generate the second light emission control signal which allows the plurality of pixels to emit light as different light emission periods for the plurality of predetermined frames according to the corresponding light emission control algorithm to transfer the generated second light emission control signal to the second light emission driver.

The light emission controller may further include a luminance compensator configured to measure a luminance reduction rate in one frame during the light emission driving according to the corresponding light emission control algorithm and calculate a compensation luminance value compensated so that the luminance reduction rate is included in a predetermined critical range; and an output data calculator configured to convert gray data of the image signal according to the compensation luminance value to generate an output image data signal.

When the gray depth is 1, the first switching control signal and the second switching control signal may be transferred at a gate on voltage level for the same period in each frame, respectively.

In each of the plurality of pixels, the first light emission control transistor may be provided between a driving power supply which supplies driving voltage to the pixel and the driving circuit, and the second light emission control transistor may be provided between the driving circuit and the organic light emitting diode.

Another aspect is a driving method of a display device including a plurality of pixels each of which includes a light emission control transistor controlling light emission of an organic light emitting diode emitting light in response to a driving current according to an image data signal. In detail, the driving method of a display device may include receiving an external image signal to analyze information of a gray depth from a result value obtained by summing gray data; determining a light emission control algorithm corresponding to the analyzed gray depth from the preset light emission control algorithm according to the number of the frames and the gray depth corresponding to a repetitive frame unit of the light emission driving; generating a light emission control signal so that the plurality of pixels emits light as different light emission periods for a plurality of frames which belongs to the repetitive frame unit according to the determined preset light emission control algorithm; and transferring a switching control signal of a gate on voltage level to a light emission control transistor of each of the plurality of pixels for different light emission periods of the plurality of frames according to the light emission control signal and allowing each of the plurality of pixels to emit light.

Here, the gray depth may be determined as a value stored in a carry bit among result values obtained by summing the gray data.

Further, the different light emission periods may complementarily vary for a plurality of frames which belongs to the repetitive frame unit. In this case, a sum of light emission periods which complementarily vary in the plurality of frames may be a light emission period in one frame of a general light emission driving.

A brightness value of an image displayed for different light emission periods of the plurality of frames which belong to the repetitive frame unit may be a brightness value according to gray data included in the external image signal.

In the analyzing of the information of the gray depth, the gray depth may be calculated by summing the gray data by a unit of all pixels included in the display panel or a unit of a plurality of pixels included in each pixel line.

In the case where the analyzed gray depth is not 1, the driving method of a display device may further include measuring a luminance reduction rate in one frame during the light emission driving according to the determined light emission control algorithm and calculating a compensation luminance value compensated so that the luminance reduction rate is included in a predetermined critical range; and converting gray data of the image signal according to the compensation luminance value to generate an output image data signal, after the determining of the light emission control algorithm.

Further, in the case where the analyzed gray depth is 1, in the generating of the light emission control signal, the light emission control signal may be generated so that the plurality of pixels emits light as the same light emission period every the entire frame, and in the light-emitting of the plurality of pixels, a switching control signal of a gate on voltage level may be generated and transferred to a light emission control transistor of each of the plurality of pixels for the same light emission period according to the light emission control signal.

DETAILED DESCRIPTION

Figure 1:
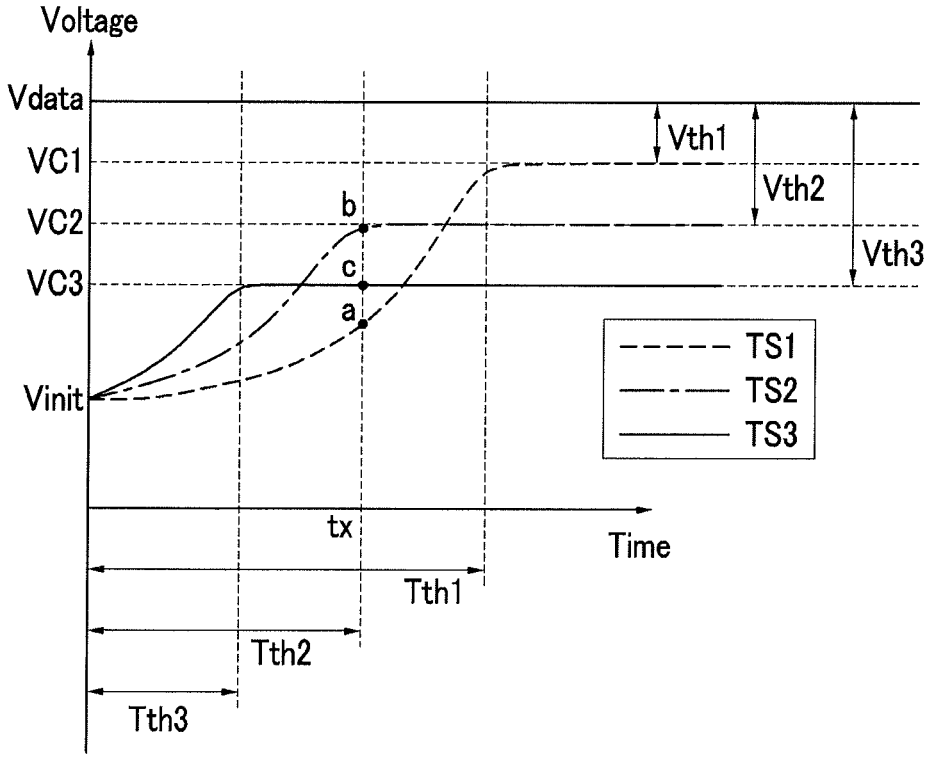
FIG. 1 is a graph illustrating a relationship between threshold voltage distribution and a compensation time of a driving transistor of a pixel in a display device.

In one pixel of an active matrix OLED (hereinafter, referred to as an OLED display), the emission degree of the OLED is controlled by controlling a driving transistor which supplies a driving current according to data voltage to the OLED.

A difference in threshold voltage and current mobility among a plurality of driving transistors may occur in a display panel of the OLED display. The difference may occur according to a characteristic of poly-silicon, and manufacturing process, method, and environment of the driving transistor. In addition, the difference may occur even due to deterioration of the driving transistor according to an increase in a usage time (display period) of the OLED display.

Although the same data voltage is applied to each pixel circuit, the outputted emission degree of the pixel varies due to a non-uniform threshold voltage characteristic of the driving transistor. Accordingly, a spot phenomenon like relatively dark sandy particles occurs on a bright screen. That is, when the threshold voltage of the driving transistor is not uniform, although the same data voltage is applied, gate-source voltage Vgs output of the driving transistor which is directly associated with a driving current supplied to the organic light emitting diode varies. Accordingly, an accurate gray shade is not expressed according to a data signal and a spot occurs, and as a result, display quality is reduced.

The technology of compensating an image through compensation of threshold voltage distribution of the driving transistor has been developed. However, as a display panel is enlarged or scaled-up, a method of driving the display panel at a high-speed frame rate is required. This results in the problems of a limited compensation time and the reproduction quality of a gray scale pixel is reduced.

Embodiments will be described more fully hereinafter with reference to the accompanying drawings. As those skilled in the art would realize, the described embodiments may be modified in various different ways, all without departing from the spirit or scope of the present disclosure. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a graph illustrating a relationship between threshold voltage distribution and a compensation time of a driving transistor of a pixel in a display device.

Characteristics of constituent elements vary due to factors such as characteristics, a manufacturing method, and a manufacturing environment of polysilicon configuring a base substrate in a manufacturing process of a plurality of pixels included in a display panel of a display device.

Particularly, although the same data voltage is applied, luminance of light emitted by each pixel may vary according to a characteristic of a driving transistor which supplies a driving current according to data voltage to the organic light emitting diode of a pixel and controls the driving current. Since the characteristic of threshold voltage of the driving transistor is not uniform for each pixel, the emission degree of each pixel varies and the luminance difference causes a gray spot phenomenon like scattering dark sandy particles in a bright screen of the display panel.

In FIG. 1, pixels in which the threshold voltage of the driving transistor is differently distributed in the display panel are representatively exemplified as a first pixel TS1, a second pixel TS2 and a third pixel TS3.

In one embodiment, assuming that a transistor configuring the pixels is a PMOS, the PMOS will be mainly described. Accordingly, in a graph of FIG. 1, predetermined data voltage Vdata may be variable in a minus value. That is, in the graph of FIG. 1, an increase of a Y-axis represents that an absolute value is increased in a minus area.

In addition, threshold voltage of the driving transistor of the first pixel TS1 is VC1 which is close to the predetermined data voltage Vdata, threshold voltage of the driving transistor of the second pixel TS2 is VC2, and threshold voltage of the driving transistor of the third pixel TS3 is VC3. Accordingly, differences between the predetermined data voltage Vdata and the threshold voltage values of the driving transistors of the first to third pixels are Vth1, Vth2, and Vth3.

In order to compensate the threshold voltage of each driving transistor, a gate electrode and a drain electrode of the driving transistor are diode-connected with each other and thus gate electrode voltage needs to be maintained at the respective corresponding threshold voltage values VC1 to VC3.

However, initial voltage applied before compensation of the threshold voltage in the driving of the pixel is applied to the gate electrode of the driving transistor of the pixel.

As shown in FIG. 1, the initial voltage Vinit was applied with the same value that is the predetermined value.

As a result, a compensation period in which the initial voltage Vinit drops to the threshold voltages VC1 to VC3 of respective driving transistors of the first to third pixels varies. That is, in the driving transistor of the first pixel TS1, a compensation time taken when a current flows out from the initial voltage Vinit to the threshold voltage VC1 is the longest as Tth1. On the contrary, in the driving transistor of the third pixel TS3, a compensation period taken when a current flows out from the initial voltage Vinit to the threshold voltage VC3 is the shortest as Tth3.

The compensation times Tth1 to Tth3 vary according to the threshold voltage characteristic of the driving transistor.

When the display device is driven at high speed and thus a sufficient compensation time is not ensured and the threshold voltage is compensated for the same predetermined reference compensation time tx, a gate voltage value of the driving transistor of the second pixel TS2 reaches b and a gate voltage value of the driving transistor of the third pixel TS3 reaches c, and as a result, each threshold voltage is sufficiently compensated. However, a gate voltage value of the driving transistor of the first pixel TS1 reaches a and thus the threshold voltage is not compensated.

Thus, when the data voltage according to the data signal is applied to the first pixel TS1, voltage different from intended data voltage is outputted and thus the emission degree is different from that of other pixel of the display panel. This causes a gray spot.

As such, the expression degree of the gray spot is low as the data voltage starting from the fixed initial voltage is decreased. In other words, the expression of the spot is reduced as bright luminance is emitted in the pixel configured by the PMOS transistor. That is, in the case where a data signal is in a low gray, the gray spot is further easily generated in the display panel and is recognized well.

One embodiment controls the emission driving of the plurality of pixels in the display device in order to prevent the gray spot due to the threshold voltage distribution of the driving transistor. One embodiment distributes an emission time for each frame or each line for at least plurality of frames in pixel emission driving in the display device.

Figure 2:
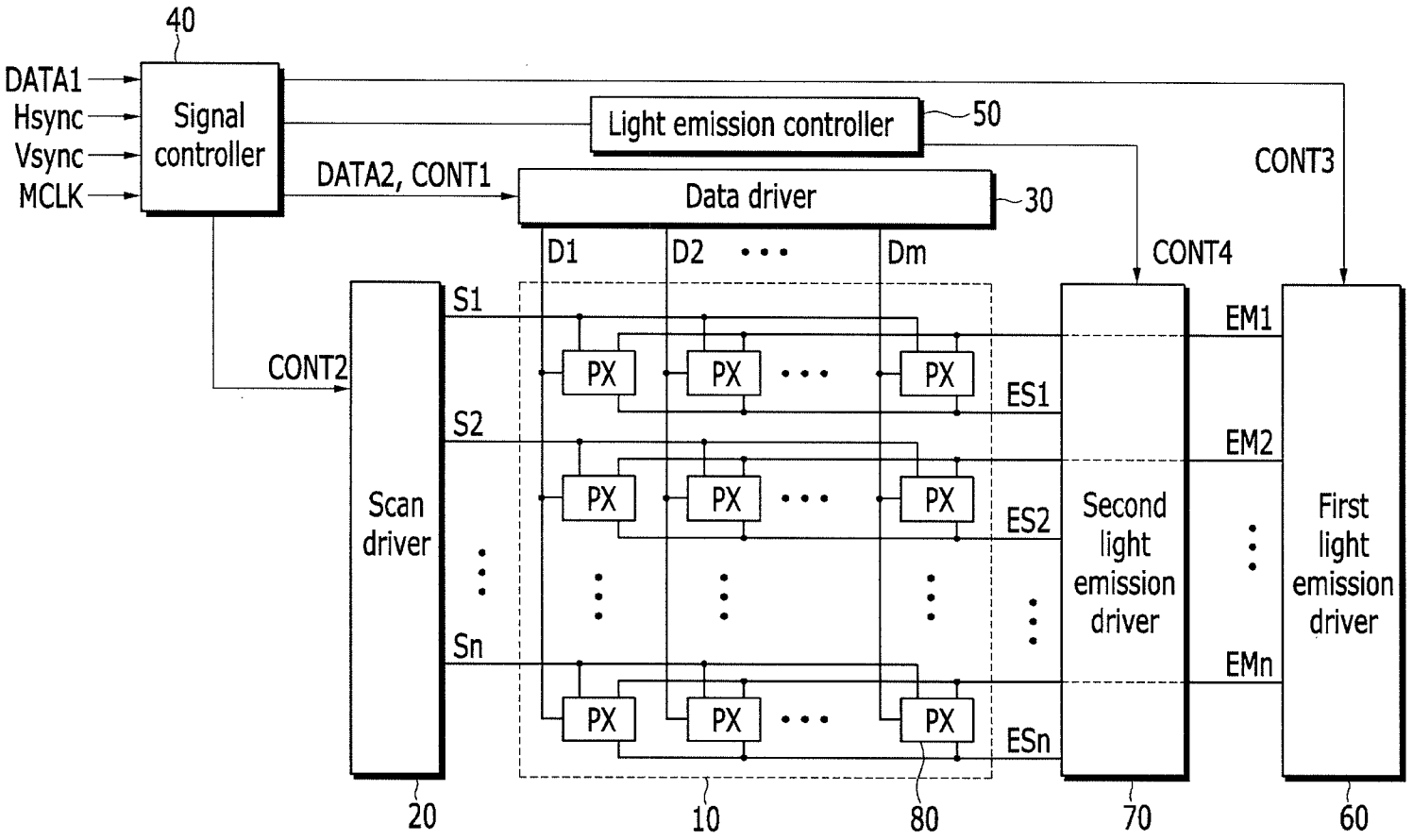
FIG. 2 is a block diagram schematically illustrating a configuration of a display device according to an embodiment.

A block diagram illustrating a configuration of a display device for performing emission control driving according to an embodiment is shown in FIG. 2.

Referring to FIG. 2, the display device includes a display panel 10 including a plurality of pixels 80, a scan driver 20, a data driver 30, a signal controller 40, a light emission controller 50, a first light emission driver 60, and a second light emission driver 70.

The display panel 10 includes the plurality of pixels 80 which is disposed in a matrix form in a plurality of regions formed when a plurality of scan lines and a plurality of data lines are substantially perpendicular to each other. The display panel 10 displays an image according to a data signal transferred through the data line.

Each of the plurality of pixels 80 is positioned in a predetermined region where a plurality of scan lines S1-Sn arranged in one direction and a plurality of data lines D1-Dm arranged in a substantially perpendicular direction to the one direction cross each other. In addition, each of the pixels is connected with the corresponding scan line among the scan lines and the corresponding data line among the data lines. Each of the pixels displays an image by self-emission of a light emitting element caused by a driving current according to a data signal transferred through the corresponding data line.

Further, in the display device shown in FIG. 1, each of the pixels may be connected to a corresponding first light emission control line among a plurality of first light emission control lines EM1-EMn extending in parallel in one direction and a corresponding second light emission control line among a plurality of second light emission control lines ES1-ESn, respectively.

The scan driver 20 is connected with the plurality of scan lines S1-Sn which is connected to each of the pixels included in the display panel 10. The scan driver 20 responds to a scan control signal CONT2 supplied from the signal controller 40 and generates a scan signal corresponding to each of the pixels included in the display panel 10 to supply the generated scan signal through the corresponding scan line of the scan lines S1-Sn.

The data driver 30 is connected with the data lines D1-Dm which is connected to each of the pixels included in the display panel 10. The data driver 30 responds to a data driving control signal CONT1 supplied from the signal controller 40. Accordingly, the data driver 30 generates a data signal corresponding to each of the pixels included in the display panel 10 to supply the generated data signal through the corresponding data line among the data lines D1-Dm. In detail, an image-processed data signal DATA2 is sampled and latched to be converted into a gamma reference voltage according to a data signal.

According to one embodiment, when luminance according to an external image signal DATA1 is reduced according to an emission control driving mode of the pixel, the image-processed data signal DATA2 may be a data signal in which the reduced luminance value is compensated.

The signal controller 40 receives and analyzes the image signal DATA1 from the outside and performs the image processing to generate the image data signal DATA2 and transfer the generated image data signal to the data driver 30.

Further, a control signal controlling each driver of the display device is generated to be transferred to the corresponding driver. In detail, the control signal includes a scan control signal CONT2 controlling an operation of the scan driver 20, a data driving control signal CONT1 controlling an operation of the data driver 30, and a first light emission control signal CONT3 controlling an operation of the first light emission driver 60.

Meanwhile, the signal controller 40 is connected with the light emission controller 50 and transfers data information of the external image signal DATA1 in order to control light emission driving of the pixel of the display panel 10 according to one embodiment.

In addition, in some cases, the signal controller 40 transfers the data information of the image signal in order to compensate luminance of the external image signal DATA1, or receives output data in which a luminance compensated value calculated in the light emission controller 50 is reflected to transfer the received output data to the data driver 30 as the image data signal DATA2.

In order to control the light emission driving of each pixel of the display panel 10 according to one embodiment, the signal controller 40 may transfer a control signal so as to activate an operation of the light emission controller 50 in synchronization at the input time of the external image signal.

The signal controller 40 receives a vertical synchronization signal Vsync, a horizontal synchronization signal Hsync, a data enable signal DE, a clock signal MCLK, and the like from the outside to generate the control signal. That is, the signal controller 40 may control operation timings of the scan driver 20, the data driver 30, the light emission controller 50 and the first light emission driver 60 by using timing signals such as the vertical synchronization signal Vsync, the horizontal synchronization signal Hsync, the data enable signal DE, the clock signal MCLK and the like.

Since a frame period may be determined by counting the data enable signal DE for 1 horizontal period among the timing signals, the vertical synchronization signal Vsync and the horizontal synchronization signal Hsync which are supplied from the outside may be omitted.

The light emission controller 50 starts driving according to an operation timing of the control signal transferred from the signal controller 40.

In detail, the light emission controller 50 generates a second light emission control signal CONT4 controlling emission driving of each pixel included in the display panel to transfer the generated second light emission control signal CONT4 to the second light emission driver 70. In this case, the second light emission control signal CONT4 may control the entire emission mode of the pixels included in the display panel for each frame, or control an emission mode of a pixel included in each pixel line of the display panel for each line.

Further, when the light emission controller 50 controls the light emission driving of each pixel according to one embodiment, the light may not be emitted with target luminance according to an original input image signal DATA1 and thus the light emission controller 50 compensates the luminance reduction. That is, the data signal compensated by the reduced luminance value may be outputted.

Hereinafter, the detailed configuration of the light emission controller 50 will be described with reference to FIG. 3.

Meanwhile, the display device includes the first light emission driver 60 and the second light emission driver 70.

The first light emission driver 60, as a means controlling the light emission driving of each pixel of the general display panel 10, is connected to the signal controller 40 and may include a voltage converter DAC. Accordingly, a plurality of first switching control signals (not shown) corresponding to the first light emission control lines EM1-EMn which is connected to each pixel of the display panel 10 is generated and transferred according to the first light emission control signal CONT3 generated from the signal controller 40. The voltage converter DAC (not shown) included in the first light emission driver 60 controls output voltage of the first switching control signals at a gate on/off voltage level according to the first light emission control signal CONT3 to output the controlled output voltage.

The second light emission driver 70, as a means controlling the light emission driving of each pixel of the display panel 10 according to one embodiment for each frame or each pixel line, is connected to the light emission controller 50. The second light emission driver 70 may also include the voltage converter DAC. Accordingly, a plurality of second switching control signals (not shown) corresponding to the plurality of second light emission control lines ES1-ESn which is connected to each pixel of the display panel 10 is generated and transferred according to the second light emission control signal CONT4 generated from the light emission controller 50. The voltage converter DAC (not shown) included in the second light emission driver 70 controls output voltage of the second switching control signals at a gate on/off voltage level according to the second light emission control signal CONT4 to output the controlled output voltage.

The first switching control signal controls an on/off switching operation of the first light emitting transistor included in each pixel of the display panel 10.

Further, the second switching control signal controls an on/off switching operation of the second light emitting transistor included in each pixel of the display panel 10.

Here, the first light emitting transistor and the second light emitting transistor are switches which are provided on a path of a current flowing in the organic light emitting diode in each pixel. Hereinafter, a detailed circuit structure of the pixel and a configuration of the first and second light emission drivers will be described with reference to FIG. 4.

The light emission driving of the pixel according to one embodiment means a driving which controls a light emission time and a light emission order of the pixel.

Further, the light emission driving is controlled by an interleaving mode for each frame or each pixel line. In one embodiment, the interleaving mode means a mode in which the light emission time and the light emission order are complementarily determined within the predetermined number of consecutive frames by a frame unit or a pixel line unit. For example, when the all pixels complementarily emit the light in two frames, light emission times of the all pixels are set to be different from each other for each frame by a frame unit, or the light emission times of the pixels included in the corresponding pixel line are set to be different from each other for each frame by a line unit so that the brightness sum of the two frames becomes original brightness.

The first light emission driver 60 controls a general light emission driving of each pixel included in the display panel 10.

In order to control the light emission driving of the pixel according to one embodiment, the signal controller 40 may start a driving of the light emission controller 50 in synchronization at the driving time of the first light emission driver 60.

Accordingly, the driving of the second light emission driver 70 may start by generating the second light emission control signal CONT4 controlling the light emission driving of each pixel in the light emission controller 50 to transfer the second light emission control signal CONT4 to the second light emission driver 70.

In the case of a pixel emission driving of a general display panel, the light emission controller 50 may generate the second light emission control signal CONT4 so as to be the same as the first light emission control signal CONT3. Then, according to the first light emission control signal CONT3 and second light emission control signal CONT4, first switching control signals transferred to each pixel from the first light emission driver 60 and second switching control signals transferred to each pixel from the second light emission driver 70 are equally transferred, and the pixels of the display panel 10 may sequentially emit light according to a line as a general pixel emission mode in response thereto.

Meanwhile, in the case of the pixel emission driving of the display panel according to one embodiment, the light emission controller 50 starts the operation according to the signal controller 40, but may generate the second light emission control signal CONT4 which is controlled differently from the first light emission control signal CONT3.

In this case, the light emission controller 50 determines a level of a gray depth according to a result value obtained by summing up gray data values of the input image signal and determines a control mode of the light emission driving of the all pixels for each frame according to the level of the gray depth or determines a control mode of the light emission driving of the pixels included in each pixel line. In addition, the second light emission control signal CONT4 is generated according to the determined light emission driving.

Then, although being driven in a general light emission mode according to the first switching control signals transferred to each pixel of the display panel, each pixel of the display panel is driven in the interleaving mode by generating the second light emission control signal CONT4 driven in the light emission mode according to the gray depth in the light emission controller 50 to transfer the second switching control signals to each pixel. Hereinafter, the detailed interleaving mode according to one embodiment will be described with reference to FIG. 4.

Figure 3:
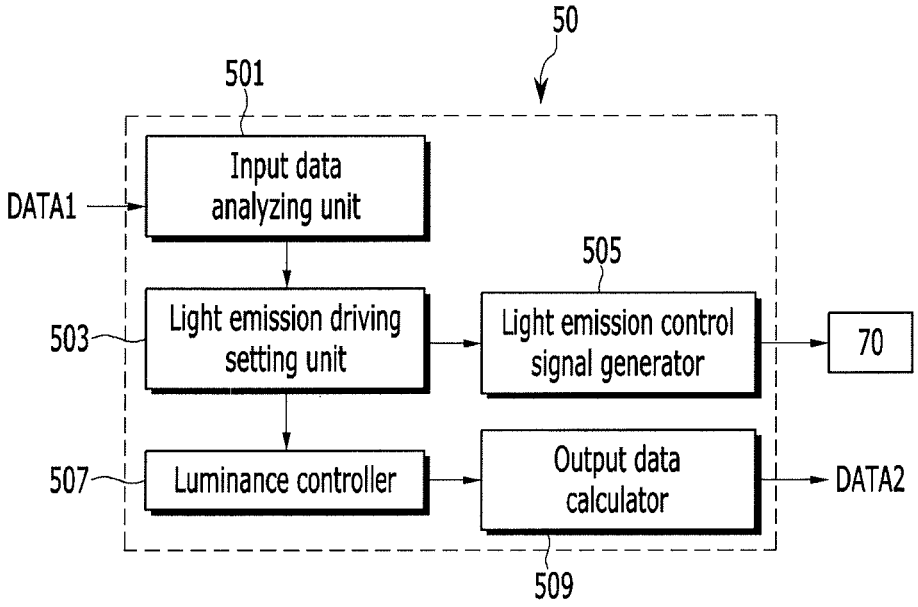
FIG. 3 is a block diagram schematically illustrating a configuration of a light emission controller of the display device of FIG. 2.

In detail, the configuration of the light emission controller 50 in the display device of FIG. 2 is illustrated in FIG. 3.

Referring to FIG. 3, the light emission controller 50 generates the second light emission control signal CONT4 to transfer the second light emission control signal CONT4 to the second light emission driver 70. Further, the light emission controller 50 receives an inputted image signal DATA1 and processes the inputted image signal DATA1 according to an exemplary embodiment to generate a predetermined output image data signal DATA2.

The light emission controller 50 includes an input data analyzing unit 501, a light emission driving setting unit 503, a light emission control signal generator 505, a luminance controller 507, and an output data calculator 509 in order to perform the function.

First, the input data analyzing unit 501 may receive the image signal DATA1 inputted from the outside through the signal controller 40 or directly. The input data analyzing unit 501 acquires a result value by using gray information included in the received original image signal DATA1.

To this end, gray values for a plurality of pixels of each pixel line unit or all pixels of a frame unit of the display panel are summed up.

In this case, the summed gray values are stored in a [n:0]bit length, and a value in which the summed values exceed [n:0] is stored in a [k:n+1]carry bit.

The result value calculated in the input data analyzing unit 501 selects only the carry bit, and has a carry bit value to calculate the gray depth of the entire data used in a line unit or a frame unit at a predetermined level, that is, 1 to n levels. Here, the gray depth means a level according to the carry bit after leaving a low-order bit having a predetermined length corresponding to a share obtained by summing the gray data of the input image signal. A length of the low-order bit varies according to a used algorithm and thus is not particularly specified.

In one embodiment, the light emission is controlled for each pixel line or each frame of the display panel according to a size of the carry bit, that is, the gray depth according to the carry bit.

For example, when a carry bit value calculated by summing the gray data of the input image signals of the entire frame is 4 and the gray depth is drawn out to level 4, the corresponding frame may be controlled so as to select an interleaving light emission driving according to the gray depth of level 4.

Further, when the gray depth is drawn out such that carry bit values calculated by summing the gray data of the input image signals of the line unit are sequentially 1, 3, 5, 2 and the like from the first line, the light emission order is determined for each line and the interleaving light emission driving of each line may be performed according to a frame.

In FIG. 3, the light emission driving setting unit 503 predetermines the light emission driving mode according to each gray depth and determines the corresponding light emission driving mode according to the result value of the gray depth transferred from the input data analyzing unit 501.

In one embodiment, the interleaving light emission driving mode is a driving mode in which light is emitted at luminance according to the inputted data signal by complementarily conducting the light emission order or the light emission time for at least one frame (hereinafter, referred to as a repetitive unit frame). In other words, the interleaving emission mode is a mode in which the light emission order or the light emission time is symmetrized for each pixel line or for the all pixels for the repetitive unit frame to emit light at original brightness.

Accordingly, in one embodiment, the interleaving light emission driving mode is not particularly limited and may be variously set. The light emission driving setting unit 503 sets the interleaving light emission driving mode performed for a predetermined number of frames for each pixel line or in the all pixels of the display panel.

In this case, the interleaving light emission driving mode may be set in response to a gray level of the original input image signal for each pixel line or in the all pixels.

According to the interleaving light emission driving mode, when the light emission of the pixel line or the all pixels is equally performed for every frame, as compared with a known light emission driving mode in which luminance of a portion where a light emission off time is long is reduced, uniform and accurate luminance expression may be performed by controlling luminance so as to have a high peak in a short light emission time.

The light emission driving setting unit 503 may determine a light emission driving time or a light emission order of the corresponding line or the corresponding frame according to a gray depth of the input image signal in a line or frame unit.

For example, since level 1 is a level having the thinnest gray depth, level 1 may be determined by a general light emission driving mode as light emission of 100%.

Further, since level n is a level having the deepest gray depth, the interleaving light emission driving mode may be applied so that only about 50% light emission period of the original light emission period is maintained for one frame.

One embodiment relates to the light emission driving mode of the all pixels of a frame unit, and the light emission driving mode according to a gray depth for a pixel line may variously set the interleaving light emission driving mode so that not only the light emission period but also the light emission order of the line may be controlled according to a level of each gray depth.

The light emission driving mode determined in the light emission driving setting unit 503 needs to re-control luminance so as to be the original luminance of the input image signal as the interleaving mode when the luminance is reduced as the light emission time is decreased.

The luminance controller 507 may control a luminance value of the image signal so as to display the image signal as a target luminance value depending on the input image signal DATA1 according to the interleaving light emission driving control mode determined in the light emission driving setting unit 503. That is, after a brightness value (Y value) is extracted from the input image signal DATA1, the brightness value is changed in accordance with a luminance rate reduced due to the light emission driving mode controlled according to the gray depth in the light emission driving setting unit 503. An increase in the Y value compensated according to the luminance reduction rate of the brightness value of the input image signal is calculated.

The increase of the calculated brightness value (Y value) is transferred to the output data calculator 509, and the output data calculator 509 processes the increase of the calculated brightness value as a luminance compensation amount of the data signal transferred to each pixel by using the changed Y value to transmit the output image data signal DATA2. The output image data signal DATA2 compensated by corresponding to the luminance reduction rate in the output data calculator 509 may be directly transferred to the data driver 30, but may be transferred to the signal controller 40 for another image signal processing.

Meanwhile, the controlled light emission driving mode for each pixel is determined according to a gray depth by a pixel line or a frame unit in the light emission driving setting unit 503 and then the information is transferred to the light emission control signal generator 505.

The light emission control signal generator 505 generates the second light emission control signal CONT4 in order to control the light emission of each pixel for each frame depending on a light emission order or light emission time determined according to the light emission driving mode according to the gray depth corresponding to the luminance value of the original image signal to transfer the second light emission control signal CONT4 to the second light emission driver 70. A change in a voltage level, a maintaining time of the voltage level, and a transferring order of the second switching control signals transferred to each pixel may be determined so that the second light emission control signal CONT4 may emit light according to the interleaving light emission driving mode of each pixel for each frame.

Figure 4:
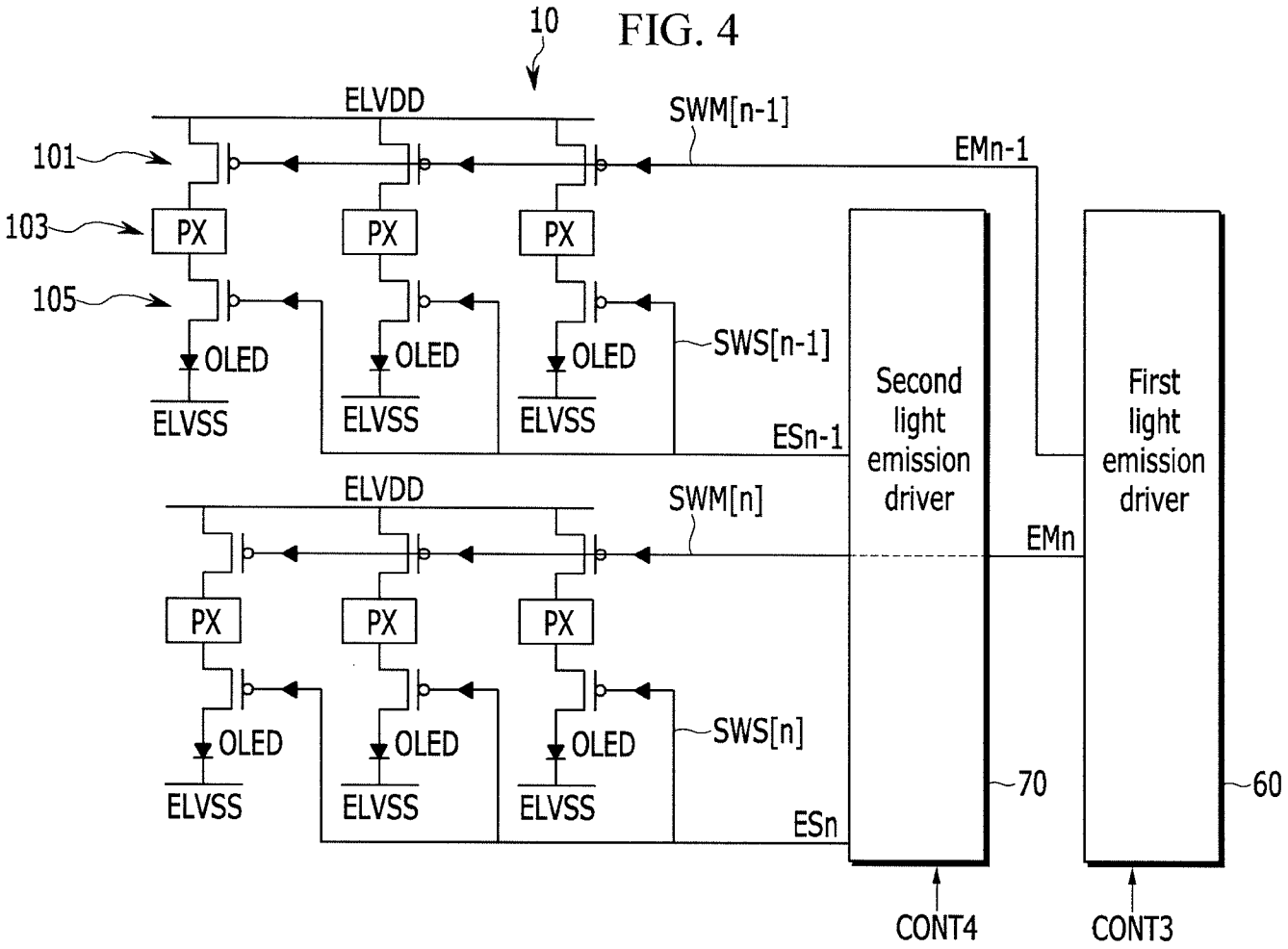
FIG. 4 is a block diagram illustrating connection of some pixels of the display panel with a first light emission driver and a second light emission driver of the display device of FIG. 2.

A detailed controlling process of the light emission driving mode of the pixel will be described with reference to FIG. 4. FIG. 4 is a block diagram illustrating connection of some pixels of the display panel with a first light emission driver 60 and a second light emission driver 70 of the display device of FIG. 2.

As described in FIG. 2, the first switching control signals are transferred from the first light emission driver 60 in order to control the light emission of each pixel for each frame, and the second switching control signals are transferred from the second light emission driver 70.

FIG. 4 illustrates some pixels included in an n−1-th pixel line and an n-th pixel line and the first light emission driver 60 and the second light emission driver 70 which are connected to the pixels.

In detail, each pixel includes a pixel driving circuit 103 provided between a first power supply ELVDD and a second power supply ELVSS and an organic light emitting diode OLED. Further, the each pixel includes two light emission control transistors, and on/off of a first light emission control transistor 101 is controlled by the first switching control signal transferred from the first light emission driver 60 and on/off of a second light emission control transistor 105 is controlled by the second switching control signal transferred from the second light emission driver 70.

Although not entirely illustrated in each pixel of FIG. 4, the first light emission control transistor, the pixel driving circuit, and the second light emission control transistor included in each pixel use like reference numerals.

The first light emission driver 60 generates and outputs the first switching control signal by the first light emission control signal CONT3 transferred from the signal controller 40.

Further, the second light emission driver 70 generates and outputs the second switching control signal by the second light emission control signal CONT4 transferred from the light emission control signal generator 40 of the light emission controller 50 as illustrated in FIG. 3.

In detail, the first light emission control transistor 101 of each pixel included in the n−1-th pixel line includes a terminal 1 connected to the first power supply ELVDD, a gate connected to the first light emission control line EMn−1 corresponding to the corresponding pixel among the plurality of first light emission control lines, and a terminal 2 connected to the pixel driving circuit 103.

In addition, the second light emission control transistor 105 of each pixel included in the n−1-th pixel line includes a terminal 1 connected to the pixel driving circuit 103, a gate connected to the second light emission control line ESn−1 corresponding to the corresponding pixel among the plurality of second light emission control lines, and a terminal 2 connected to an anode electrode of the organic light emitting diode OLED.

In FIG. 4, the first light emission driver 60 generates and transfers the corresponding n−1-th first switching control signal SWM[n−1] to the n−1-th first light emission control line EMn−1 by the first light emission control signal CONT3 and generates and transfers the n-th first switching control signal SWM[n] to the n-th first light emission control line EMn.

In addition, the second light emission driver 70 generates and transfers the corresponding n−1-th second switching control signal SWS[n−1] to the n−1-th second light emission control line ESn−1 by the second light emission control signal CONT4 and generates and transfers the n-th second switching control signal SWS[n] to the n-th second light emission control line ESn.

The first light emission control signal CONT3 is generated in accordance with a compensation timing of the threshold voltage of the driving transistor of the pixel of the display panel in the signal controller 40, and a timing of the first switching control signal generated in the first light emission driver 60 is controlled in synchronization with the compensation timing of the threshold voltage.

The second light emission control signal CONT4 is generated in the light emission controller 50, and the light emission of the pixel of the display panel is controlled by the interleaving light emission driving mode through the timing of the second switching control signal generated in the second light emission driver 70.

In one embodiment, in the case of general light emission driving, the respective pixels sequentially emit light for a light emission period of the corresponding frame for each line. To this end, the first switching control signals SWM[n−1] and SWM[n] and the second switching control signals SWS[n−1] and SWS[n] which are sequentially transferred to the respective pixels are applied at the same time and converted into a gate on voltage level to be maintained for the same time. As a result, the first light emission control transistor 101 and the second light emission control transistor 105 of each pixel are turned on at the same time and a driving current is transferred to the organic light emitting diode OLED to emit light. Accordingly, the respective pixels of the display panel sequentially emit light for the same light emission time according to a pixel line for one frame. As described above, the general light emission driving mode corresponds to the case where the gray depth is a thin level which is a level 1. Since a target luminance is displayed according to the gray data included in the input image signal in the level 1 of the gray depth applying the general light emission driving mode, the light emission controller 50 of the display device does not perform separate luminance compensation.

Meanwhile, the pixel is driven by the interleaving light emission driving mode corresponding to each gray depth when the gray depth is not in the level 1 but the rest of the levels (for example, levels 2 to n). The light emission driving mode is controlled by the second switching control signals.

That is, the first switching control signals SWM[n−1] and SWM[n] and the second switching control signals SWS[n−1] and SWS[n] are sequentially transferred along each pixel line. In this case, the first switching control signal and the second switching control signal corresponding to one pixel line are applied at the same time.

All of the first switching control signals SWM[n−1] and SWM[n] may be transferred at a gate on voltage level for a light emission period of one frame like the general light emission driving mode. However, the second switching control signals SWS[n−1] and SWS[n] are transferred for different maintaining times of the gate on voltage level for a repetitive unit frame by the light emission time or the light emission order controlled by the interleaving light emission driving mode determined according to the gray depth.

That is, in the example, when the gray depth of the corresponding input image signal of the n−1-th pixel line is in the deepest level and thus only about 50% light is controlled to be emitted by the interleaving mode, the second switching control signal SWS[n−1] is transferred to each pixel of the n−1-th pixel line so that the gate one level voltage is maintained for a time reduced by about 50% as compared with the general light emission time for one frame. Then, the second switching control signal SWS[n−1] is transferred at the gate on voltage level so that the rest of the light emitting period may be distributed for the rest of the repetitive unit frame. In the example, since the repetitive unit frame is set as two sequential frames, the rest about 50% period of the light emission period is included in a subsequent frame and the second switching control signal SWS[n−1] is transferred at the gate on voltage level for the rest about 50% light emission period.

As another example, when about 30% light is controlled to be emitted by the interleaving mode corresponding to the gray depth level of the corresponding input image signal of the n-th pixel line, the second switching control signal SWS[n] is transferred at the gate on voltage level for a time reduced by about 30% as compared with the general light emission time for one frame. In addition, the second switching control signal SWS[n] is transferred at the gate on voltage level so that the rest about 70% light emitting period is set for the subsequent frame of the repetitive unit frame.

Figure 5:
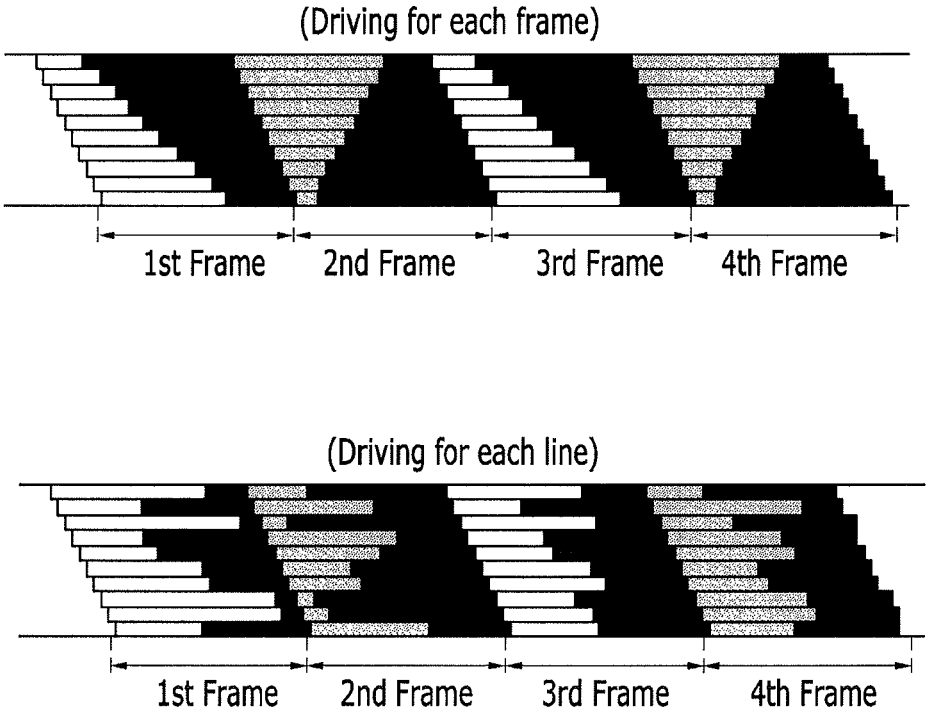
FIG. 5 is a diagram illustrating an example of light emission driving according to a driving method of a display device according to another embodiment.

Forms in which the light is differently emitted for the repetitive unit frame according to an interleaving light emission driving mode are exemplified in FIG. 5. Referring to FIG. 5, the repetitive unit frame is two sequential frames, and forms of light emission driving for each frame and light emission driving for each line are exemplified in the two sequential frames.

However, the light emission driving forms of FIG. 5 are just exemplified and are not limited to the above embodiment.

It is sufficient so long as the repetitive unit frame may be configured by at least two frames. In this case, a sum of brightness values of the plurality of pixels for each line or the all pixels for each frame which emit light for the repetitive unit frame may be the same as the luminance value included in the original input image signal.

Further, the light emission period is not sequentially increased or decreased like the driving for each frame of FIG. 5, but may be controlled in various forms.

Referring to the driving for each frame of FIG. 5, two sequential frames such as a first frame 1st Frame and a second frame 2nd Frame, and a third frame 3rd Frame and a fourth frame 4th Frame configure one repetitive unit frame.

The first switching control signal and the second switching control signal corresponding to each line are transferred to the all pixels in the first frame 1st Frame. All of the plurality of first switching control signals are applied at the gate on voltage for the light emission period of the corresponding frame, while the second switching control signal is applied so that the maintaining time of the gate on voltage level is gradually increased from the first pixel line to the last pixel line according to a control of the light emission driving. Accordingly, the light emission period is gradually increased according to the pixel line for the first frame 1st Frame. In addition, on the contrary to the first frame 1st Frame, the plurality of second switching control signals is applied so that the maintaining time of the gate on voltage level is gradually decreased from the first pixel line to the last pixel line according to a control of the light emission driving in the next second frame 2nd Frame.

As a result, the brightness value due to the light emission of the all pixels becomes a brightness value of the original input image data for a period that is a sum of the light emission periods of the first frame 1st Frame and the second frame 2nd Frame.

Similarly, in the case of the driving for each line, the light emission periods are complementarily determined for the repetitive unit frame by a line unit. That is, for example, to describe the first pixel line in the first frame 1st Frame and the second frame 2nd Frame as an example the first second switching control signal is transferred at the gate on voltage level for about 70% period of the entire light emission period in the first frame 1st Frame. In addition, the gate on voltage level of the first second switching control signal is maintained for about the rest 30% period in the second frame 2nd Frame which is the rest of the repetitive unit frame. As a result, the brightness values of the pixels included in the first pixel line become brightness values of the image signals inputted in the pixels included in the first original pixel line for a period that is a sum of the light emission periods of the first frame 1st Frame and the second frame 2nd Frame.

Figure 6:
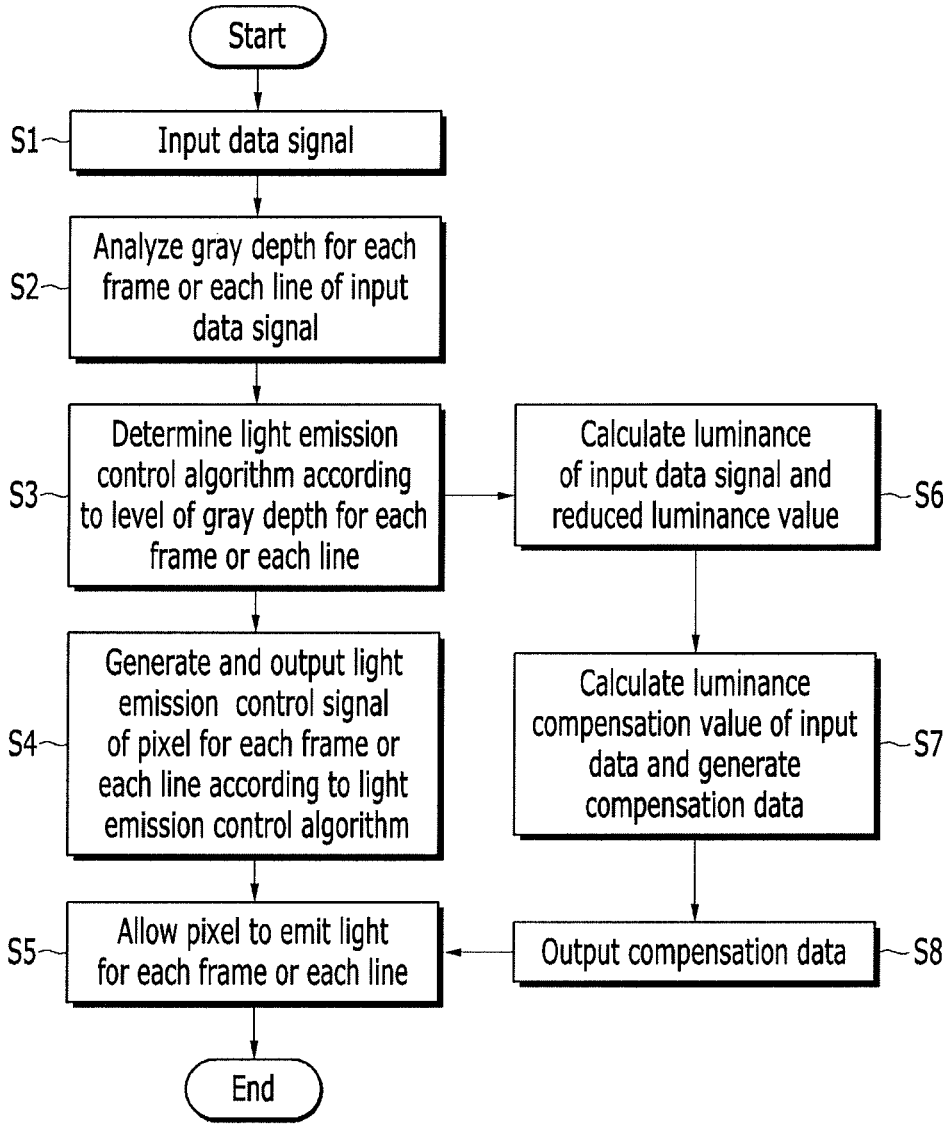
FIG. 6 is a flowchart illustrating a driving method of a display device according to another embodiment.

FIG. 6 is a flowchart illustrating a driving method of a display device according to another embodiment. Respective processes of FIG. 6 will be described in association with the display device according to the exemplary embodiment of FIGS. 2 and 3 and constituent elements of the light emission controller 50.

First, an external image signal is inputted to the signal controller 40 of the display device (S1). Luminance information and the like of the inputted data signal may be transferred to the light emission controller 50.

In the light emission controller 50, the gray depth is analyzed by summing luminance values when the whole pixels for each frame or the plurality of pixels for each pixel line emit light in response to the inputted image signal (S2). Luminance data of the input image signals for the entire frame or one line are summed and then the gray depths may be classified into a plurality of levels 1 to n by using a carry bit. However, an analyzing method of the gray depth is not necessarily limited thereto, and the gray depth may be classified into predetermined levels according to the processed result value by using the luminance data according to the input image signals.

After the gray depths are analyzed by using the luminance data of the input image signals, a light emission control algorithm corresponding to the level of the gray depth is determined for each frame or for each line (S3). In the light emission control algorithm according to each level of the gray depth, the light emission time or light emission order is controlled by a complementary driving mode (interleaving mode) in response to the gray depth for a predetermined repetitive unit frame.

The light emission control algorithm may be determined and stored in the light emission controller 50 for each level of the gray depth and for each repetitive unit frame in advance.

As the analyzed result of the gray depth, in the case where the gray depth is the thinnest level as the level 1, the interleaving light emission driving control is not performed according to a general light emission driving mode.

However, in the case where the gray depth is not the level 1 but a deeper level, the light emission control algorithm corresponding to the gray depth may be determined by using a pre-stored light emission driving mode. In addition, a light emission control signal controlling a light emission time is generated to be outputted to the plurality of pixels for each frame or for each line according to the light emission control algorithm (S4).

As described above, the light emission control signal is the second light emission control signal CONT4 generated in the light emission control signal generator 505 of the light emission controller 50, and the light emission of each pixel may be controlled while a gate on/off voltage level of the second switching control signal transferred to each pixel is controlled according to the second light emission control signal CONT4.

Since the driving current of each pixel is transferred to the organic light emitting diode to emit light for a maintaining period of the gate on voltage level of the second switching control signal transferred to each pixel, the pixel may emit light by an interleaving mode while the maintaining period is complementarily controlled in each frame of the repetitive unit frame (S5).

Meanwhile, when the light emission control algorithm according to the gray depth is determined and thus the light is emitted, luminance of the display image of each frame may be lower than target luminance according to the gray data of the original input image signal.

In order to compensate the reduced luminance, the luminance value of the input image signal reduced when the light emission is driven is calculated according to the determined light emission control algorithm (S6). Further, the target luminance according to the gray information included in the input image signal is also calculated (S6).

In addition, in order to display the image at the target luminance, the luminance compensation value for the input image signal is calculated to generate the compensation data (S7).

The luminance compensation processing for the input image signal is not a necessary step, and the gray data may not be necessarily converted so as to be accurately displayed with a target luminance value. Further, as an example, in the case where the light emission driving is performed according to the light emission control algorithm, when the luminance is reduced beyond a critical range after pre-setting a predetermined luminance reduction rate, the gray data of the input image signal may be compensated so as to emit light at the predetermined luminance reduction rate level.

The compensation data performing the luminance compensation processing for the gray data of the input image signal may be generated and outputted in the light emission controller 50 (S8).

When the image data signal through a separate luminance compensation processing is transferred to each pixel and the light emission driving is performed according to the light emission control algorithm determined according to the gray depth, the display panel of the display device is not driven at high speed and may display accurate luminance according to data. Further, since the display panel may not be driven at high speed, the compensation time of the threshold voltage of the driving transistor of each pixel may be sufficiently ensured and thus a spot generation phenomenon due to a threshold voltage difference may be prevented.

According to at least one of the disclosed embodiments, it is possible to prevent a gray spot of a display image due to a difference of threshold voltage of a driving transistor of a pixel included in a display panel in a display device and implement clear image quality.

Further, since a gray spot due to threshold voltage distribution of the driving transistor of the pixel may be compensated in the display panel through light emission control of the pixel, a high-speed driving mode using a separate frame memory or sub frame is not required, such that it is possible to provide a stable driving method improving image quality of the display device.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims, and equivalents thereof.

What is claimed is:

1. A display device, comprising:

a display panel comprising i) an organic light emitting diode configured to emit light, ii) a driving circuit, and iii) a plurality of pixels comprising a first light emission control transistor and a second light emission control transistor configured to control the light emission of the organic light emitting diode;

a first light emission driver configured to generate a first switching control signal controlling a switching operation of the first light emission control transistor;

a second light emission driver configured to generate a second switching control signal controlling a switching operation of the second light emission control transistor;

a signal controller configured to generate and transfer a first light emission control signal controlling an operation of the first light emission driver; and a light emission controller configured to generate and transfer a second light emission control signal controlling an operation of the second light emission driver, wherein the light emission controller is further configured to i) sum up gray values according to an external image signal, wherein the summed gray values are stored in a [n:0]bit length, and wherein a value in which the summed values exceed [n:0] is stored in a [k:n+1]carry bit, ii) acquire information of a gray depth from the [k:n+1]carry bit, iii) determine a light emission control algorithm according to the gray depth, and iv) generate the second light emission control signal, wherein the light emission controller is further configured to control light emission periods of the pixels so as to be different from a plurality of predetermined frames according to the light emission control algorithm, wherein n is a natural number, and k is a natural number greater than or equal to (n+1), and wherein the light emission controller is further configured to control a light emission time and a light emission order of the pixels in an interleaving manner such that the light emission order or the light emission time is symmetrical for each pixel line or for all of the pixels of the frames so as to emit light at original brightness.

2. The display device of claim 1, wherein the light emission controller is further configured to pre-set and store the number of the predetermined frames and the light emission control algorithm according to the gray depth.

3. The display device of claim 1, wherein the predetermined frames comprise light emission periods which complementarily vary according to the light emission control algorithm, as a basic unit frame repeated according to the light emission control algorithm in the entire frame.

4. The display device of claim 3, wherein the sum of the light emission periods of the predetermined frames is the same as a light emission period in one frame of a general light emission driving.

5. The display device of claim 1, wherein a brightness value of an image displayed for different light emission periods of the predetermined frames is a brightness value according to gray data included in the external image signal.

6. The display device of claim 1, wherein the first switching control signal is maintained at a gate on voltage level of the first light emission control transistor for the same period as the light emission period in one frame of the general light emission driving, and wherein the second switching control signal is maintained at a gate on voltage level of the second light emission control transistor for different light emission periods according to the light emission control algorithm.

7. The display device of claim 1, wherein the first switching control signal is configured to be transferred at a gate on voltage level of the first light emission control transistor for the same time for each frame among the predetermined frames, and wherein the second switching control signal is configured to be transferred at a gate on voltage level of the second light emission control transistor for different periods for each frame of the predetermined frames.

8. The display device of claim 1, wherein the second light emission driver is further configured to control a pulse voltage level of the second switching control signal according to the second light emission control signal.

9. The display device of claim 1, wherein the light emission controller is further configured to calculate the gray depth based on the sum of the gray data by a unit of all pixels included in the display panel or by a unit of a plurality of pixels included in each pixel line.

10. The display device of claim 1, wherein the light emission controller comprises:

an input data analyzer configured to analyze information of a gray depth from the result value obtained based on the sum of the gray data according to the external image signal;

a light emission driving setting unit configured to pre-set the gray depth and a light emission control algorithm according to the number of the predetermined frames and determine a light emission control algorithm corresponding to a gray depth of the analyzed image signal among the set light emission control algorithms; and a light emission control signal generator configured to generate the second light emission control signal which allows the pixels to emit light for different light emission periods for the predetermined frames according to the corresponding light emission control algorithm to transfer the generated second light emission control signal to the second light emission driver.

11. The display device of claim 10, wherein the light emission controller further comprises:

a luminance compensator configured to measure a luminance reduction rate in one frame during the light emission driving according to the corresponding light emission control algorithm and calculate a compensation luminance value compensated so that the luminance reduction rate is included in a predetermined critical range, and an output data calculator configured to convert gray data of the image signal according to the compensation luminance value to generate an output image data signal.

12. The display device of claim 1, wherein the first switching control signal and the second switching control signal are configured to be transferred with a gate on voltage level for the same period in each frame, respectively.

13. The display device of claim 1, wherein the first light emission control transistor is provided between a driving power supply which supplies driving voltage to the pixel and the driving circuit, and wherein the second light emission control transistor is provided between the driving circuit and the organic light emitting diode.

14. A driving method of a display device comprising a plurality of pixels each of which includes a light emission control transistor controlling light emission of an organic light emitting diode emitting light in response to a driving current according to an image data signal, the method comprising:

receiving an external image signal to analyze information of a gray depth from a [k:n+1]carry bit obtained based on the sum of gray values, wherein the summed gray values are stored in a [n:0]bit length, wherein a value in which the summed values exceed [n:0] is stored in the [k:n+1] carry bit, and wherein n is a natural number, and K is a natural number greater than or equal to (n+1);

determining a light emission control algorithm corresponding to the analyzed gray depth from the preset light emission control algorithm according to the number of the frames and the gray depth corresponding to a repetitive frame unit of the light emission driving;

generating a light emission control signal so as to control light emission periods of the pixels are to be different for a plurality of predetermined frames which belongs to the repetitive frame unit according to the determined light emission control algorithm;

transferring a switching control signal of a gate on voltage level to a light emission control transistor of each of the pixels for different light emission periods of the frames according to the light emission control signal and allowing each of the pixels to emit light; and controlling a light emission time and a light emission order of the pixels in an interleaving manner such that the light emission order or the light emission time is symmetrical for each pixel line or for all of the pixels of the consecutive frames so as to emit light at original brightness.

15. The driving method of claim 14, wherein the different light emission periods complementarily vary for a plurality of frames which belongs to the repetitive frame unit.

16. The driving method of claim 15, wherein the sum of the light emission periods is the same as a light emission period in one frame of a general light emission driving.

17. The driving method of claim 14, wherein a brightness value of an image displayed for different light emission periods of the frames which belongs to the repetitive frame unit is a brightness value according to gray data included in the external image signal.

18. The driving method of claim 14, wherein in the analyzing of the information of the gray depth, the gray depth is calculated by summing the gray data by the a unit of all pixels included in the display panel or by a unit of a plurality of pixels included in each pixel line.

19. The driving method of claim 14, further comprising:

after the determining of the light emission control algorithm, measuring a luminance reduction rate in one frame during the light emission driving according to the determined light emission control algorithm and calculating a compensation luminance value compensated so that the luminance reduction rate is included in a predetermined critical range; and converting gray data of the image signal according to the compensation luminance value to generate an output image data signal.

20. The driving method of claim 14, wherein in the generating of the light emission control signal, the light emission control signal is generated so that the pixels emit light during the same light emission period every frame, and wherein in the allowing of the pixels to emit light, a switching control signal of a gate on voltage level is generated and transferred to a light emission control transistor of each of the pixels for the same light emission period according to the light emission control signal.

* * * * *